US006761363B2

(12) United States Patent
Fask et al.

(10) Patent No.: US 6,761,363 B2
(45) Date of Patent: Jul. 13, 2004

(54) RUNNER AND METHOD OF MANUFACTURE

(75) Inventors: Richard J. Fask, Worcester, MA (US); George T. (Crow) Smith, II, Ventnor, NJ (US); James M. Boudreau, Milford, MA (US)

(73) Assignee: HIP Technologies, LLC, Shrewsbury, MA (US)

( * ) Notice: Subject to any disclaimer, the term of this patent is extended or adjusted under 35 U.S.C. 154(b) by 0 days.

(21) Appl. No.: 09/953,994

(22) Filed: Sep. 17, 2001

(65) Prior Publication Data

US 2002/0056972 A1 May 16, 2002

Related U.S. Application Data

(60) Provisional application No. 60/234,462, filed on Sep. 21, 2000.

(51) Int. Cl.[7] ..... A63C 1/32

(52) U.S. Cl. ..... 280/11.18; 280/11.12

(58) Field of Search ..... 280/607, 11.14, 280/11.18, 11.12, 11.17, 7.13, 841, 7.11, 7.12, 11.15, 618, 608; 29/17.3, 81.16, 883, 889.71, 766, 266

(56) References Cited

U.S. PATENT DOCUMENTS

| | | | | | |
|---|---|---|---|---|---|
| 1,115,790 | A | * | 11/1914 | Drevitson | 280/11.17 |
| 1,319,094 | A | * | 10/1919 | Kerrigan | 280/11.12 |
| 3,212,786 | A | | 10/1965 | Florjancic et al. | |
| 3,558,149 | A | | 1/1971 | Weidenbacker | |
| 3,934,892 | A | | 1/1976 | Baikie | |
| 3,954,278 | A | | 5/1976 | McLeod | |
| 3,967,832 | A | | 7/1976 | Chambers | |
| 4,088,335 | A | | 5/1978 | Norton et al. | |
| 4,093,249 | A | | 6/1978 | Chambers | |
| 4,223,900 | A | * | 9/1980 | Olivieri | 280/11.12 |
| 4,251,086 | A | | 2/1981 | Woolley | |
| 4,314,708 | A | * | 2/1982 | Zuuring | 280/11.18 |
| 4,336,948 | A | | 6/1982 | Couture | |
| 4,351,537 | A | * | 9/1982 | Seidel | 280/11.12 |
| 4,744,574 | A | | 5/1988 | Soo | |
| 4,907,813 | A | | 3/1990 | Hall | |
| 5,257,793 | A | * | 11/1993 | Fortin | 280/7.13 |
| 5,332,242 | A | * | 7/1994 | Cann et al. | 280/11.18 |
| 5,360,227 | A | | 11/1994 | Lemelson | |
| 5,484,148 | A | * | 1/1996 | Olivieri | 280/11.18 |
| D373,399 | S | * | 9/1996 | Both | D21/225 |
| 5,769,434 | A | | 6/1998 | Wurthner | |
| 5,988,683 | A | * | 11/1999 | Venier et al. | 280/841 |
| 6,039,328 | A | * | 3/2000 | Pawlowski et al. | 280/7.13 |
| 6,105,975 | A | * | 8/2000 | Shum | 280/7.13 |
| 6,109,622 | A | * | 8/2000 | Reynolds | 280/11.17 |

FOREIGN PATENT DOCUMENTS

| | | |
|---|---|---|
| CA | 585720 | 10/1959 |
| NL | 9 402 249 A | 8/1996 |

OTHER PUBLICATIONS

T–Blade Canada, Inc. , t–blade technology Brochure.
Industrial Designers Society of America, Wurthner t'Blade, p. 1–2, (Dec. 5, 1998). www.idsa.org/seewhat/idea98/winners/wurthner.htm.
Eurosport, "Brochure—Eurosport New for 2000,".
ASTM Designation: F737–86, "Standard Performance Specification for Ice Hockey Skate Blades," ( Dec. 5, 1998).
Hockey Business News, Transcontinental Sports Publications, vol. 7 ( No. 2), p. 10, 18, 23, 24, 26 ( Feb. 5, 2001). copy of whole document attached.

* cited by examiner

*Primary Examiner*—Brian L. Johnson
*Assistant Examiner*—Hau Phan
(74) *Attorney, Agent, or Firm*—Salter & Michaelson

(57) ABSTRACT

An improved runner and method of manufacture. The runner is formed by insert injection molding a steel insert blade, by which the total weight of the runner may be reduced substantially in comparison to conventional steel runners having similar size and shape. A skate blade and an ice skate including the improved runners are also provided.

36 Claims, 17 Drawing Sheets

RUNNER AND METHOD OF MANUFACTURE

RELATED CASES

Priority under 35 U.S.C. §119(e) is hereby claimed to U.S. Provisional Patent Application Ser. No. 60/234,462 to Fask et al., which was filed on Sep. 21, 2000.

BACKGROUND

1. Technical Field

The present disclosure is related to a runner and skate blade and, in particular, to a runner and skate blade in which the runner is formed by insert injection molding.

2. Related Art

Ice skating encompasses several sports including ice hockey, figure skating, speed skating, ice dancing, and exhibition skating, each of which may use slightly different ice skates that have been developed in response to the different requirements for each sport. Traditional ice skate construction includes a leather laced boot supported by a steel skate blade. "Skate blade," as used herein, refers to the entire assembly of the bridge components and the runner. "Bridge," as used herein, refers to the entire assembly attached to the runner and which attaches the runner to the boot.

The runner of a skate blade is generally formed from hardened steel which is able to withstand the forces encountered during each ice skating sport. "Runner," as used herein, refers to that portion of the ice skate in contact with the ice. Experienced and/or professional skaters generally develop a preference for a particular contour or profile of the bottom edge of the runner, which contacts the ice. Therefore, runners must be able to withstand periodic contouring according to the preferences of each skater. In addition, runners typically require periodic sharpening to maintain a sharp edge, which maintains its glide characteristics. Both sharpening and contouring involve removing a portion of the steel from which the runner is formed. The amount of material removed may vary substantially based on the condition of the runner and the force used when the runner is sharpened. Thus, runners eventually wear out and must be replaced after repeated sharpening and/or contouring.

Over time, much attention has been given to reducing the overall weight of ice skates in general, regardless of the sport in which they are used. Some improvements related to reducing the overall weight of ice skates have involved replacing the materials of construction with newer, more lightweight materials as they are developed. For example, some improvements have been related to replacing leather components with more lightweight man-made materials such as plastic.

One improvement involved replacing a portion of the steel skate blade with a plastic bridge while attaching a steel runner to the runner holder portion of the bridge. "Runner holder," as used herein, refers to that portion of the bridge which is attached to the upper part of the runner and provides rigidity to the runner. In addition to the advantages of weight reduction, another advantage of a skate blade comprising a plastic bridge and steel runner is that the runner can be removed for sharpening, contouring, and/or replacement.

Many commercially available ice skates include such skate blades, variations of which are available under product names such as Tuuk™ (available from Nike-Bauer), Crow™, Prolite™ (available from CCM), Cobra™ (available from Graf), as well as others from manufacturers such as Mission and Easton. Typically, such commercially available plastic bridges include at least two spaced apart fastening apertures into which the steel runner may be attached using well known fasteners.

Although steel has been the most widely used material for runners, it remains one of the heavier components of an ice skate. Thus, more recent attempts to reduce the overall weight of an ice skate have focused on decreasing the weight of the runner itself. One attempt involved providing a plurality of apertures in the runner, as in the Bauer Vapor ice skate (available from Tuuk), and the Nike Quest ice skate.

Other attempts to reduce the weight of the skate blade involved applying a relatively thin strip of steel to the bridge, as disclosed in U.S. Pat. No. 5,248,156 to Cann et al. and as in the T'Blade™ ice skate (disclosed in U.S. Pat. No. 5,769,434 to Würthner) and Rebellion™ ice skates. Because the steel strip on such ice skates is relatively thin, the runner cannot be sharpened or contoured according to the preferences of individual skaters.

Any improvement relating to reducing the weight of ice skates or components of ice skates which allows for sharpening and contouring is desirable.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

SUMMARY

Figure 1:
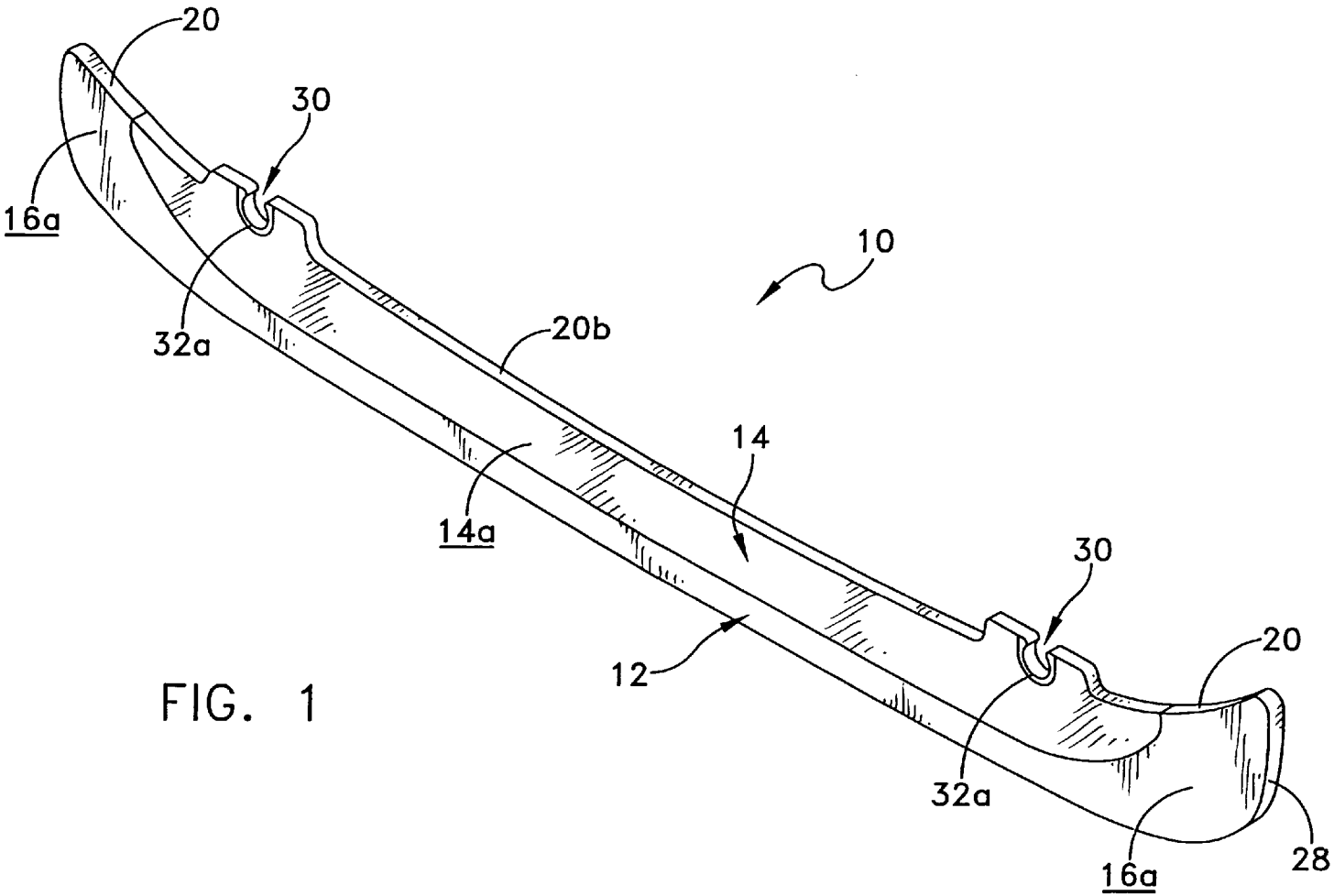
FIG. 1 is a perspective view of one embodiment of an insert injection molded runner according to the present disclosure.

In one embodiment, the present disclosure is directed to a runner that includes an insert blade having an upper edge extending between a toe end and a heel end, a lower, skating edge, and opposed side surfaces. Each opposed side surface includes a recessed region having a recessed surface. Each recessed region is spaced apart from the lower, skating edge and extends between the toe end and the heel end for a preselected distance. A polymeric material covers at least a portion of each recessed region.

In another embodiment, the disclosure is directed to a runner that includes a first surface and a second surface substantially parallel to the first surface. Each surface includes an insert blade portion and a polymeric portion. The runner is capable of being sharpened and contoured.

In yet another embodiment, the disclosure is directed to runner that includes an insert blade having substantially parallel opposed side surfaces and a polymeric portion having substantially parallel opposed side surfaces. At least a portion of the polymeric portion is in direct contact with the insert blade. The opposed side surfaces of the insert blade are substantially flush with the opposed side surfaces of the polymeric portion.

In another embodiment, the disclosure is directed to, in combination, a bridge and a runner. The runner has substantially parallel opposed side surfaces and includes an insert blade at least partially encased in a polymeric material. The runner is removably attached to the bridge.

In another embodiment, the disclosure is directed to a skate blade. The skate blade includes a bridge and a runner. The runner has substantially parallel opposed surfaces. Each of the opposed surfaces includes a steel portion and a polymeric portion. At least about ¼ inch of steel extends from a lower edge of the polymeric material to a skating edge of the runner.

In another embodiment, the disclosure is directed to an ice skate that includes a boot, a bridge, and a runner. The runner has substantially parallel opposed surfaces. Each surface includes a metal portion and a polymeric portion. At least about ¼ inch of metal extends from a lower edge of the polymeric material to a skating edge of the runner.

DETAILED DESCRIPTION OF THE PREFERRED EMBODIMENTS

The present disclosure is directed to a runner that is substantially lighter in weight than most commercially available runners and that is capable of being sharpened and contoured according to individual preferences. A portion of the runners according to the present disclosure are plastic, resulting from the insert injection molding of an insert blade. The runners of the present disclosure are formed with substantially parallel sides that allow sharpening and contouring of the skating edge using conventional sharpening equipment.

The present disclosure may be applied to any type of ice skate, for example, ice hockey skates, figure skates, speed skates, and the like. Thus, in some instances, the disclosure is directed to a runner and other instances, to a runner holder or bridge, at least a portion of which has been insert injection molded in order to reduce the total weight of the ice skate, while allowing the runner to be sharpened and contoured using conventional sharpening equipment.

The present disclosure is also directed to a runner holder, a skate blade including the runner or the runner holder, and to ice skates that include the runner, runner holder, and/or skate blade. The present disclosure is also directed to methods of forming the same.

FIG. 1 illustrates a perspective view of an exemplary unitary ice hockey runner 10 according to the present disclosure. The present embodiment of ice hockey runner 10 may be compatible with bridges manufactured by, for example, Tuuk and Crow. Those of ordinary skill in the art will recognize that an ice hockey runner is used herein for illustrative purposes only, and that the present disclosure applies to runners used in other ice skates as well, for example, figure skate runners, speed skate runners, and the like. As shown, runner 10 has a narrow, elongated shape and includes an insert blade indicated generally at 12 and a polymeric portion indicated generally at 14. Preferably, runner 10 may be formed by insert injection molding a polymeric material about the insert blade using a well known process such that the insert blade is at least partially encased in a high strength polymeric material. "Insert blade," as used herein, refers to that portion of the runner or runner holder that is insert injection molded.

Figure 2:
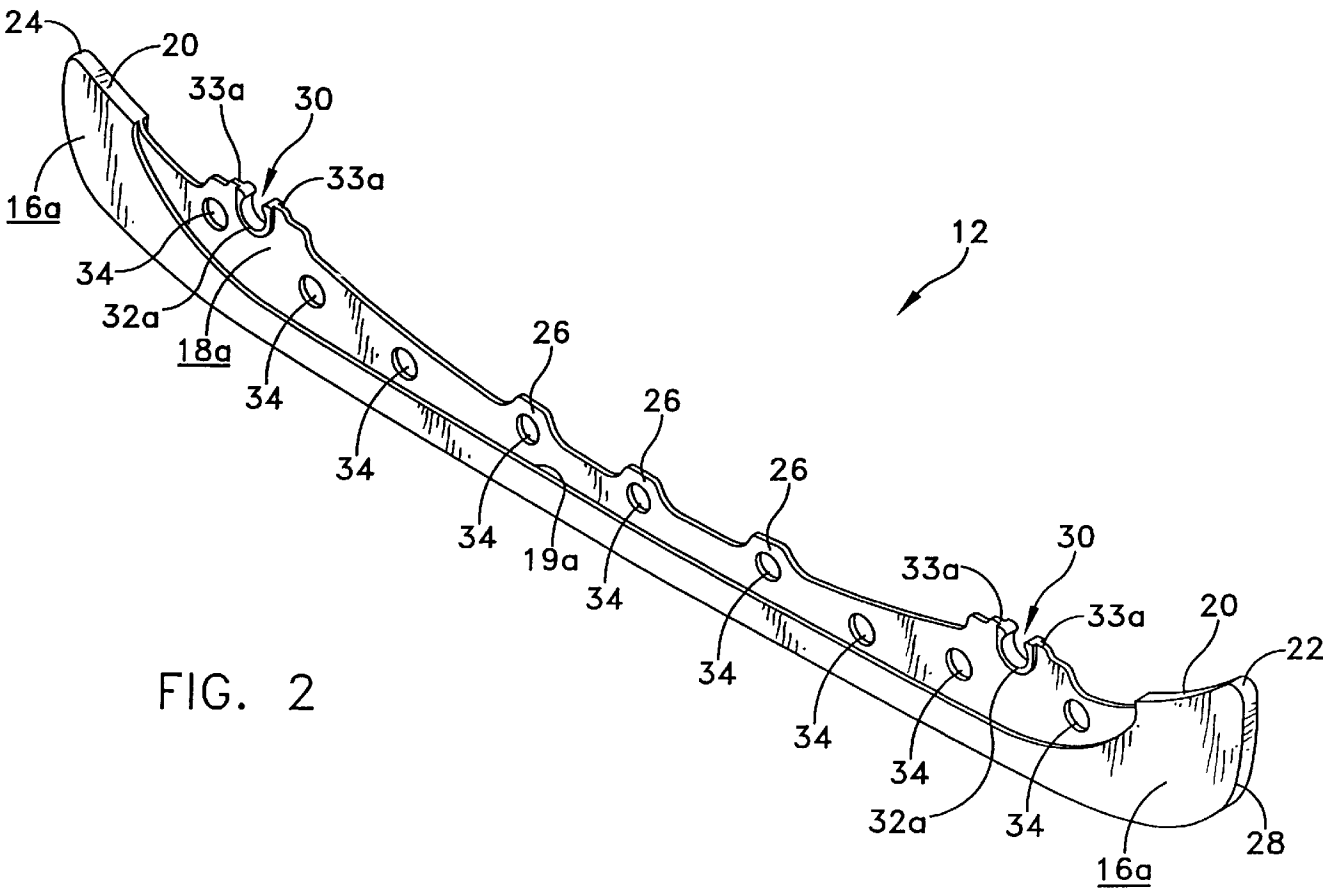
FIG. 2 is a perspective view of the insert blade of the runner of FIG. 1, before insert injection molding.
Figure 3:
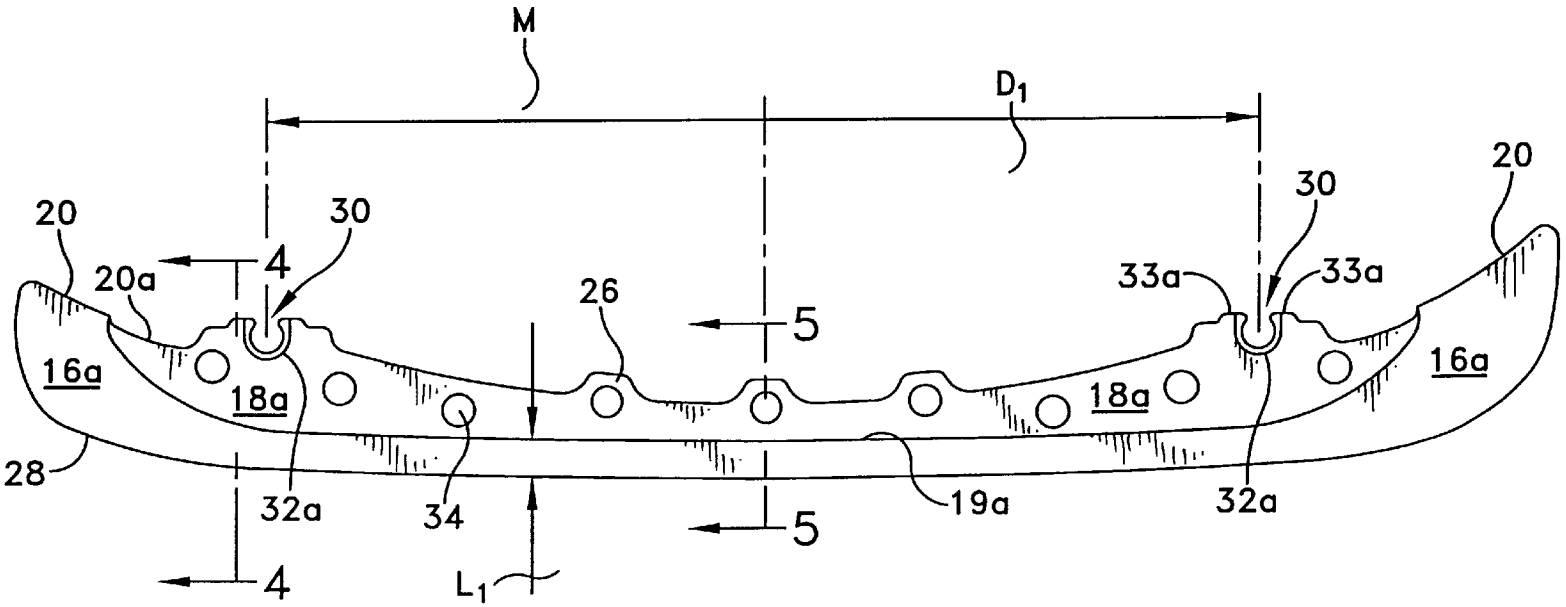
FIG. 3 is a side view of the insert blade shown in FIG. 2.

Insert blade 12 is shown in greater detail in FIGS. 2 and 3 without the polymeric portion 14. Insert blade 12 includes an upper edge 20 extending between a toe end 22 and a heel end 24, and substantially parallel opposed surfaces 16*a, b*. Each opposed surface 16*a, b* includes a recessed region 18*a, b* having a lower edge defined by a lip 19*a, b* and an upper edge 20*a* defined by the recessed regions 18*a, b*, and having a thickness less than that of upper edge 20, as will be described in greater detail below.

With continued reference to FIGS. 2 and 3, upper edge 20*a* of upper edge 20 includes three tabs 26. It is not necessary to include tabs 26, but it has been found that the tabs provide stabilization to runner 10 when assembled in a bridge, as will be described in greater detail below. Those of skill in the art will recognize that the shape, size, number, and placement of the tabs may be varied as needed. Insert blade 12 also has a lower, skating edge 28 which is contoured to extend upwardly to intersect upper edge 20 at toe end 22 and heel end 24.

With continued reference to FIGS. 2 and 3, upper edge 20*a* includes at least two fastening apertures 30, which are designed to receive a fastener (not illustrated) to allow attachment of runner 10 to a bridge, which will be illustrated in greater detail below. Although illustrated herein with two fastening apertures, those of ordinary skill in the art will recognize that any number may be included, as needed for attachment to a particular bridge. Apertures 30 include flanges 32*a, b* extending outwardly from recessed regions 18*a, b*, which facilitate attachment of the fasteners to runner 10. Adjacent each fastening aperture 30 are shoulders 33*a*, which extend from upper edge 20*a* by about 0.050 inch.

With continued reference to FIGS. 2 and 3, insert blade 12 also includes a plurality of bores 34 disposed within and extending through recessed regions 18*a, b* transversely to the longitudinal axis of the runner. The purpose of bores 34 is to allow molten polymeric material to flow transversely through the bores during the insert injection molding process, as is well known in the art. Those of skill in the art will recognize that the size, shape, number, and placement of the bores may be varied as needed.

Referring now to FIG. 3, the portion of insert blade 14 below lips 19*a, b* and extending to lower edge 28 has a length $L_1$. Generally, it is desirable to maximize the length of $L_1$, which will allow repeated sharpenings of the runner before replacement is necessary and will allow individuals sufficient material to contour the runner according to individual preferences. Preferably, $L_1$ is at least about ⅛ inch, more preferably at least about ¼ inch, and more preferably still at least about ⅜ inch. Those of ordinary skill in the art will recognize that $L_1$ can be varied by varying the position of lip 19*a, b* and consequently the dimensions of recessed regions 18*a, b.*

With continued reference to FIG. 3, in the present embodiment, fastening apertures 30 are preferably spaced apart from a midpoint "M" of insert blade 12 and from toe and heel ends 22, 24. The shape of the runner and the number and type of fasteners may be varied in order to conform to bridges available by a number of different manufacturers. Thus, runners according to the present disclosure may be tailored to be compatible with any of the previously mentioned commercially available bridges by changing, for example, the shape of the runner or the position of the fasteners. The distance "$D_1$" between apertures 30 may vary depending upon a variety of factors including, but not limited to, the size of the boot support holder to which the runner will be attached as well as other practical considerations which would be apparent to those of ordinary skill in the art. Those of skill in the art will recognize that the distance "$D_1$" between fastening apertures 30 may be adjusted according to the size of the boot support holder to which the runner may be attached. The distance "$D_1$" between apertures 30 may determined using routine experimentation by those of skill in the art.

Figure 5:
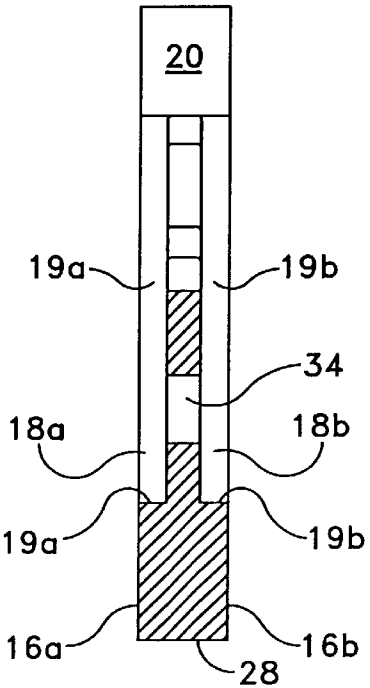
FIG. 5 is a cross-sectional view along line 5—5 of the insert blade shown in FIG. 3.
Figure 4:
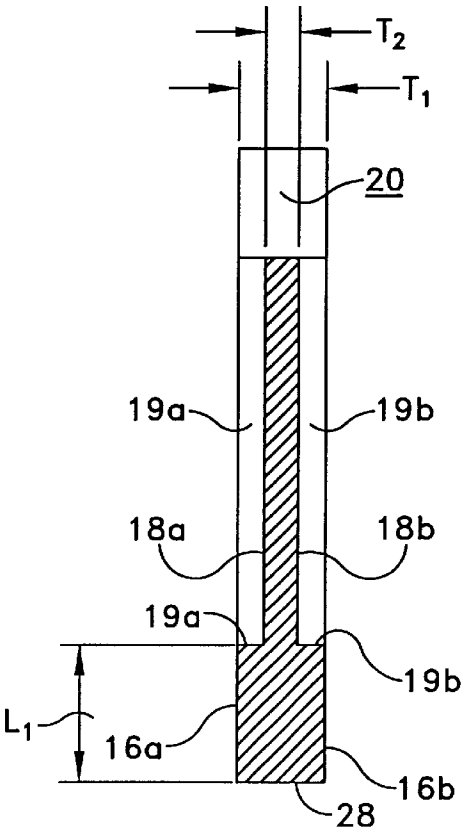
FIG. 4 is a cross-sectional view along line 4—4 of the insert blade shown in FIG. 3.

Referring now to the cross-sectional views of insert blade 12 (before injection molding) shown in FIGS. 4 and 5, insert blade 12 preferably has a thickness "$T_1$" between opposing side surfaces 16*a, b* ranging from about 0.115 inch to about 0.125 inch, more preferably about 0.120 inch. Insert blade 12 preferably has a thickness "$T_2$" between recessed regions 18*a, b*, ranging from about 0.030 inch to about 0.060 inch, more preferably about 0.045 inch.

Suitable materials from which insert blade 12 may be formed include any material capable of withstanding the stresses of ice skating. Preferably, insert blade 12 may be formed from a material having a Rockwell hardness ranging from about 45 to about 60, more preferably about 55. Insert blade 12 is preferably formed from a metallic material. Some materials that have been found suitable are steel, stainless steel, carbon steel, and combinations thereof. In a preferred embodiment, insert blade 12 may be carbon steel having a Rockwell hardness ranging from about 52 to about 57, more preferably about 55. In some embodiments, insert blade 12 may include a non-corrosive layer on the exterior surface to prevent the formation of rust. Examples of suitable non-corrosive layers include nickel, nickel-chrome, chrome, and combinations thereof.

Figure 6:
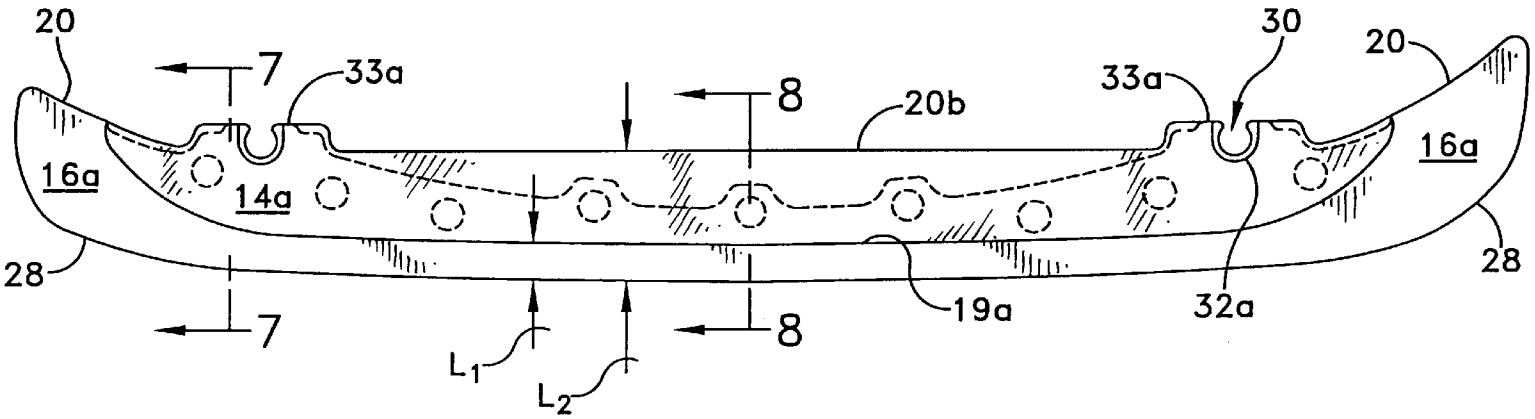
FIG. 6 is a side view of the runner of FIG. 1, showing the insert blade of FIG. 3 in outline.
Figure 8:
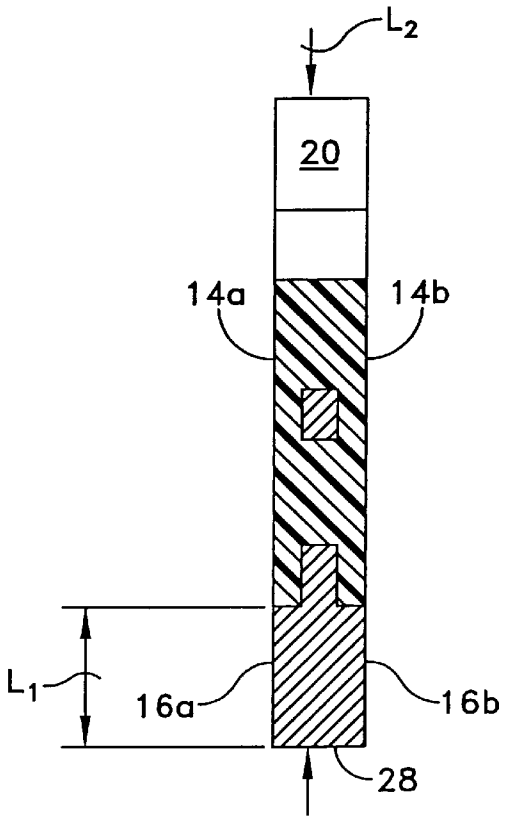
FIG. 8 is a cross-sectional view along line 8—8 of the runner shown in FIG. 6.
Figure 7:
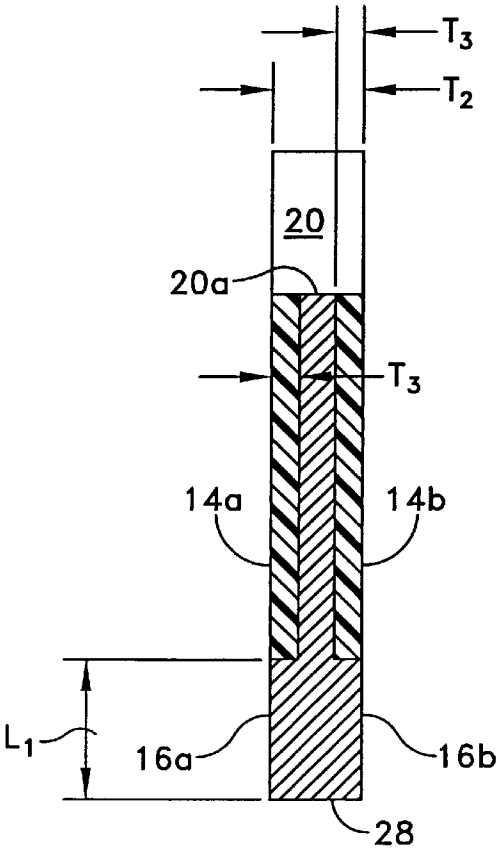
FIG. 7 is a cross-sectional view along line 7—7 of the runner shown in FIG. 6.
Figure 9:
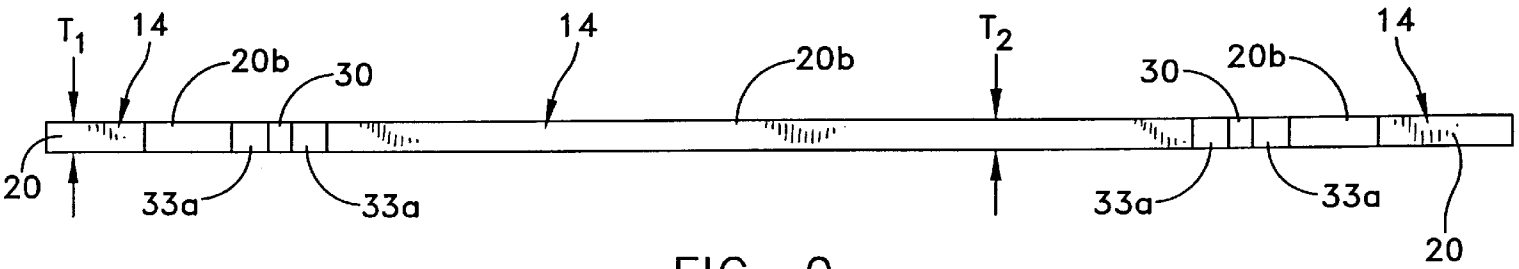
FIG. 9 is a top view of the runner of FIG. 1.

FIGS. 6, 7, and 8 when taken together illustrate side and cross-sectional views of runner 10, after insert injection molding of insert blade 12 to form polymeric portion 14, having opposed side surfaces 14*a, b*. Preferably, polymeric portion 14 extends above upper edge 20*a* of insert blade 12 and has a length $L_2$ of about 0.500 inch to about 1.000 inch, more preferably about 0.750 inch. Upper edge 20*b* of polymeric portion 14 has a thickness $T_2$ which is substantially the same as that $T_1$, which is the thickness of the insert blade between opposing side surfaces 16*a, b*. Thus, the region of polymeric portion 14 extending above upper edge 20*a* has a thickness $T_2$ ranging from about 0.115 inch to about 0.125 inch, most preferably about 0.120 inch, and the region of polymeric portion 14 adjacent recessed regions 18*a, b* has a thickness $T_3$ ranging from about 0.0250 inch to about 0.0450 inch, more preferably about 0.0375 inch. Consequently, as best seen in FIG. 9, opposed edges 16*a,b* of insert blade 12 and opposed surfaces 14*a, b* of polymeric portion 14 are flush with one another, or coplanar, resulting in a runner having substantially parallel side surfaces such that thickness of runner 10 is substantially the same from upper edge 20*b* to lower edge 28.

After insert injection molding, the ice hockey runner according to the present embodiment may weigh from about 2 percent to about 75 percent less than a conventional steel runner having substantially the same size and shape. In general, for an ice hockey runner, the insert blade may comprise about 40 percent to about 98 percent by weight of the runner and the polymeric portion may comprise about 2 percent to about 60 percent, by weight, based on the total weight of the runner. Ice hockey runners come in a range of sizes, specified by the length of the runner, i.e. 296 mm, 288 mm, 280 mm, etc. Each size corresponds generally to the size of the bridge or skate to which the runner may be attached. Those of skill in the art will recognize that the amount of weight reduction depends, in part, upon the area of the recessed regions. Thus, the weight of the runner may be decreased by increasing the proportion of polymeric portion in relation to that of the material from which the insert blade is formed. Examples of ways in which weight reduction may be maximized include increasing the area of regions 18*a, b* by moving lips 19*a, b* closer to the skating edge 28 or to toe and heel ends, increasing the number of transverse bores, etc.

Any polymeric material may be used for polymeric portion 14, limited only by practical considerations such as the weight, strength, and processing method. Both thermoplastic and thermosetting polymeric materials may be used, although thermoplastic are preferred because they are generally harder than thermosetting. Examples of such materials include high impact polystyrene, polyamide, acrylonitrile butadiene styrene, or any other relatively lightweight high-strength polymeric material, as well as combinations thereof. Nylon 66 is particularly preferred due to its relatively light weight, relatively high impact strength, toughness, stiffness, and tensile strength.

Other materials may be added to the polymeric material in order to modify its properties, to the extent that they do not interfere with the strength and/or weight reduction of the runner. For example, reinforcing materials such as carbon fiber, fiberglass, talc, metal powder, and the like may be used. In general, more lightweight materials such as fiberglass are preferred. Thus, one preferred additive is fiberglass which may be used to increase the impact strength of the material. When fiberglass is added to the polymeric material, is it preferably added in the range of about 5 percent to about 30 percent. Examples of commercially available products that have been found suitable for the present runners include Nylon 6613GF (a nylon 66 reinforced with about 13% glass fiber available from Oxford Polymers); and Zytel™ Grade ST801 (a nylon 66 reinforced with about 13% glass fiber available from DuPont Chemicals). Products with similar characteristics may be available from other manufacturers such as Bayer Chemical.

The present ice hockey runner is substantially lighter than other runners having a similar size and shape that are formed solely from steel or other metal. Commercially available ice hockey runners come in a variety of sizes generally expressed in millimeters, (e.g. 250 mm, 254 mm, 263 mm) and corresponding to foot or boot sizes. The weight of commercially available ice hockey runners formed solely from steel typically ranges from about 180 grams to about 200 grams for the larger sizes (296 mm and larger) to about 40 grams to about 60 grams for the smaller, children's sizes. The weight of the ice hockey runners according to the present disclosure may range from about 30 grams to about 150 grams, depending on the size, shape, and amount of plastic used to form the runner. For practical purposes, the lower limit of the weight of the ice hockey runners according to the present disclosure is limited by the amount of steel required to form the insert blade which may vary depending on the size, shape, and area of the recessed region. Thus, ice hockey runners according to the present disclosure may weigh from about 2 percent up to about 90 percent less, by weight, than conventional steel runners having the same size and shape, again depending on the type of runner and the size, shape, area of the recessed region, and the amount of plastic used to form the runner.

Figure 10:
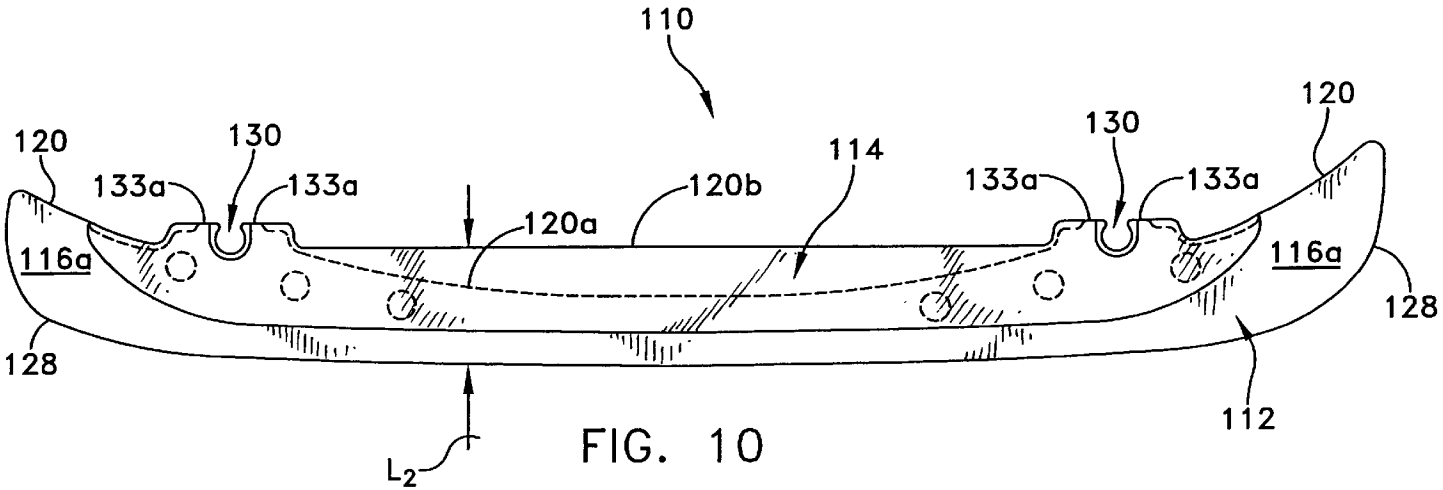
FIG. 10 is a side view of another embodiment of a runner according to the present disclosure.
Figure 11:
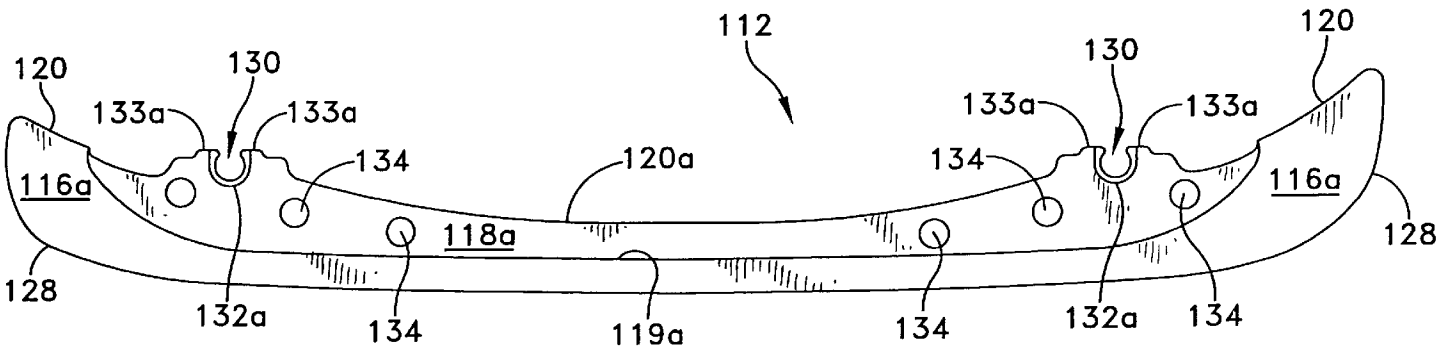
FIG. 11 is a side view of the insert blade used to form the runner shown in FIG. 10.

As discussed above, it is not necessary to include tabs 26, or to have the same arrangement of tabs as in runner 10, as illustrated by the following embodiments shown in FIGS. 10–13. FIGS. 10–11 when taken together illustrate another exemplary runner 110 which includes the same elements as in the previous embodiment, preceded by the number "1." FIG. 11 illustrates a side view of an insert blade 112 used to manufacture runner 110, as described above. Runner 110 is substantially the same as runner 10, with the exception of tabs 26, which are not included in runner 110. Similarly, the method of forming runner 110 is substantially the same as for runner 10.

Figure 12:
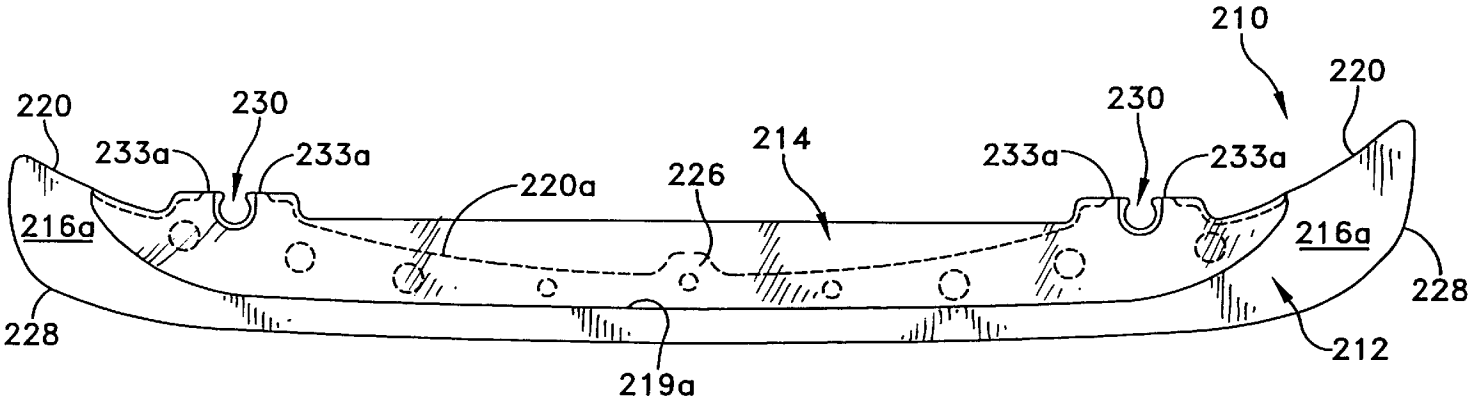
FIG. 12 is a side view of another embodiment of a runner according to the present disclosure.
Figure 13:
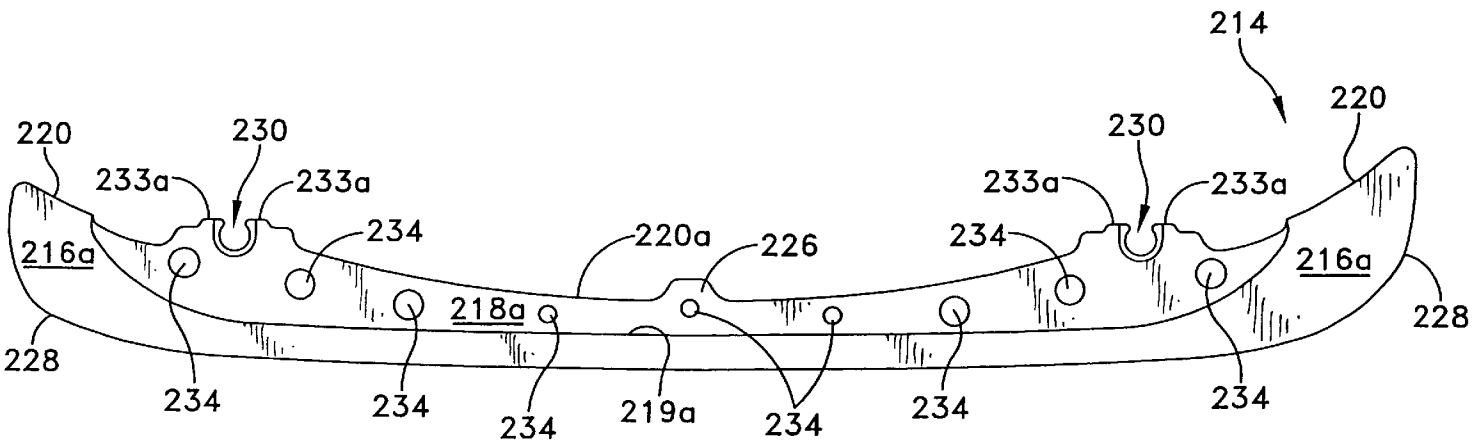
FIG. 13 is a side view of the insert blade used to form the runner shown in FIG. 12.

FIGS. 12–13 when take together illustrate another exemplary runner 210 which includes the same elements as in the previous embodiment, preceded by the number "2." FIG. 13 is a side view of an insert blade 212 that includes one stabilizing tab 226 extending from upper edge 220*a*, disposed between and spaced apart from fastening apertures 230. As in the previous embodiment shown in FIGS. 10–11, runner 210 is substantially the same as runner 10, with the exception that it includes only one tabs 226, rather than the three included in runner 10. Likewise, the method of forming runner 110 is substantially the same as for runner 10 and 110.

The method for forming runners according to the present disclosure involves first forming an insert blade having the desired shape and thickness by cutting, stamping, or machining, preferably by CNC machining, the foregoing recessed regions, fastening apertures, bores, and any other desired features according to the desired specifications. The insert blade is positioned in a suitable insert injection mold and a molten polymeric material is allowed to flow at least partially around the insert blade and transversely through the bores, after which the molten polymeric material is allowed to harden. As a result, the hardened polymeric material fixes the recessed regions of insert blade within the hardened polymeric material, and the insert blade may not be removed therefrom without cutting either the insert blade or the polymeric material.

Any of the foregoing embodiments of runners according to the present disclosure may be used in a variety of commercially available plastic bridges, which makes the present runners adaptable to a variety of existing ice skates. Moreover, because the runner has substantially parallel opposed side surfaces, it may be sharpened and contoured using conventional ice skate sharpening equipment.

Figure 14:
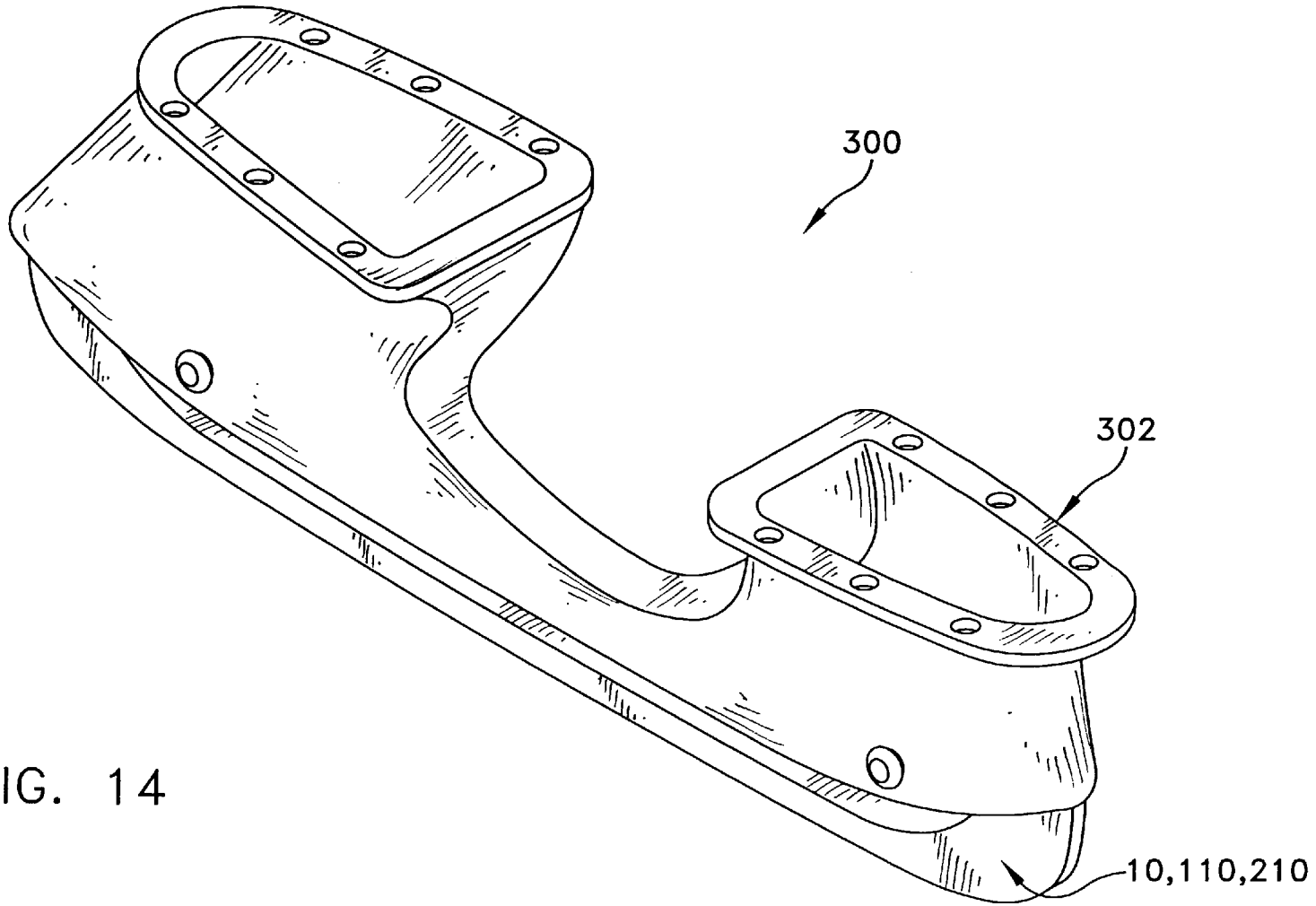
FIG. 14 is a perspective view of a runner according to the present disclosure attached to one type of a commercially available bridge.
Figure 15:
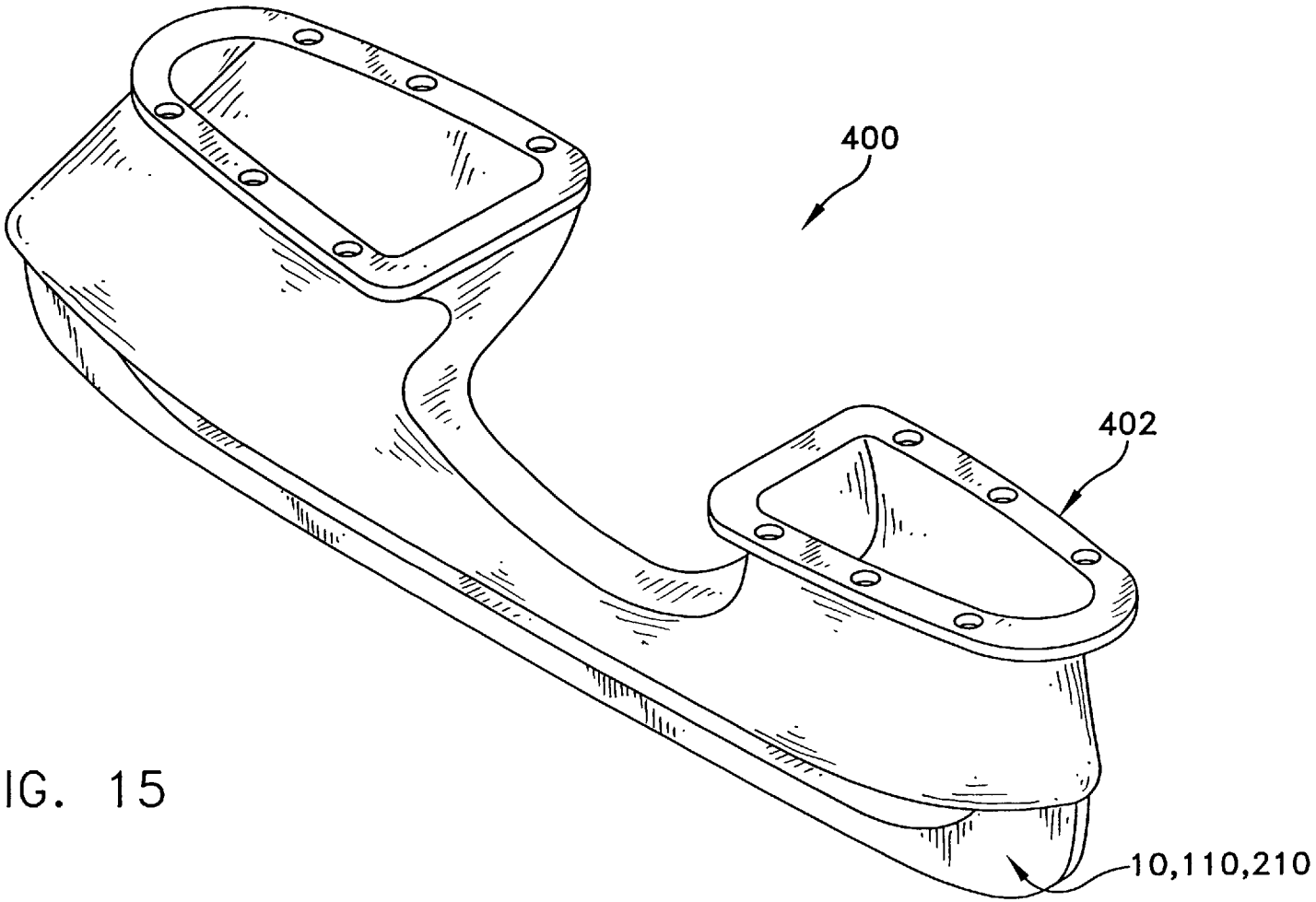
FIG. 15 is a perspective view of a runner according to the present disclosure attached to one type of a commercially available bridge.
Figure 16:
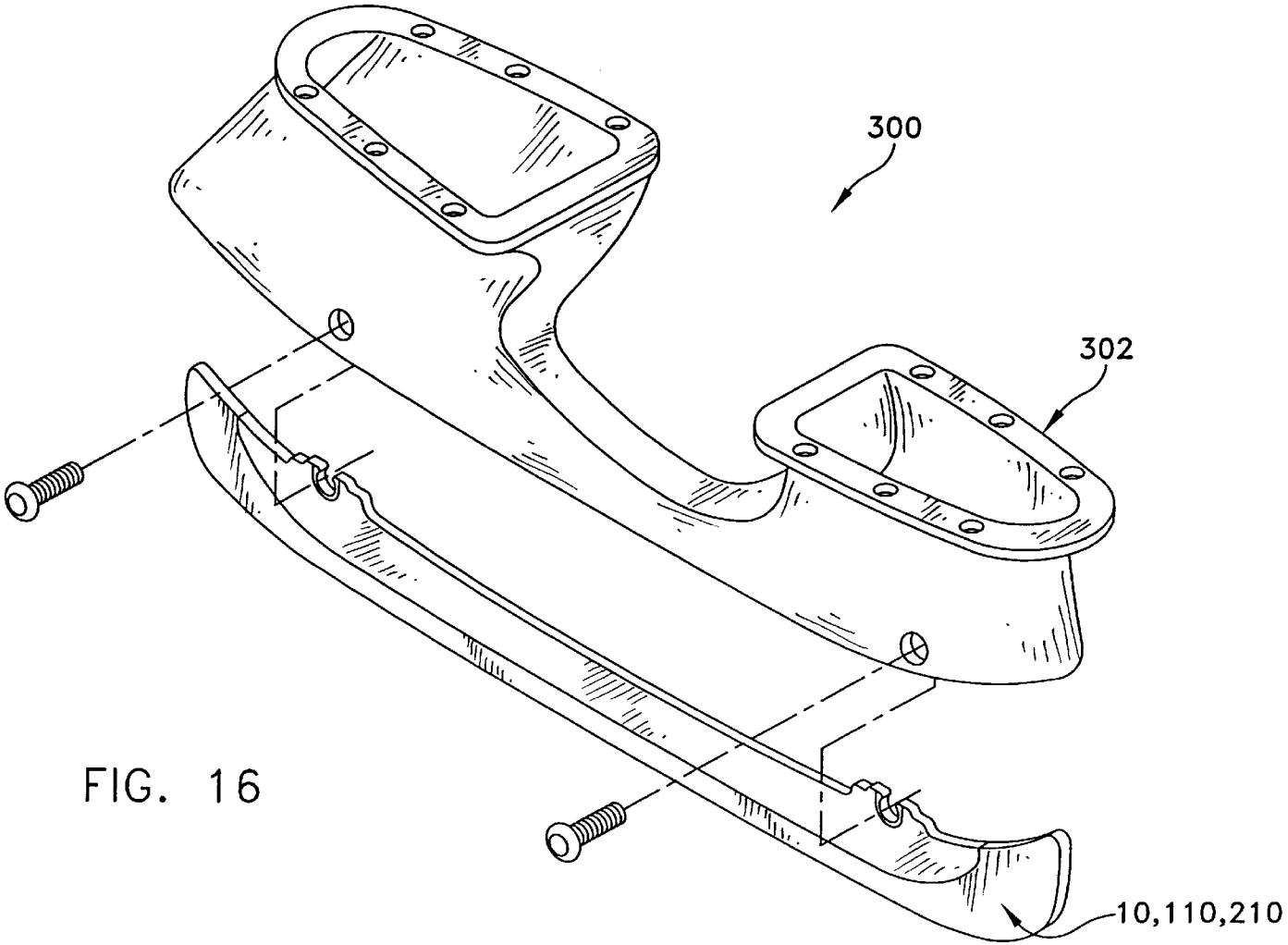
FIG. 16 is a perspective view showing the attachment of the runner and bridge shown FIG. 14.
Figure 17:
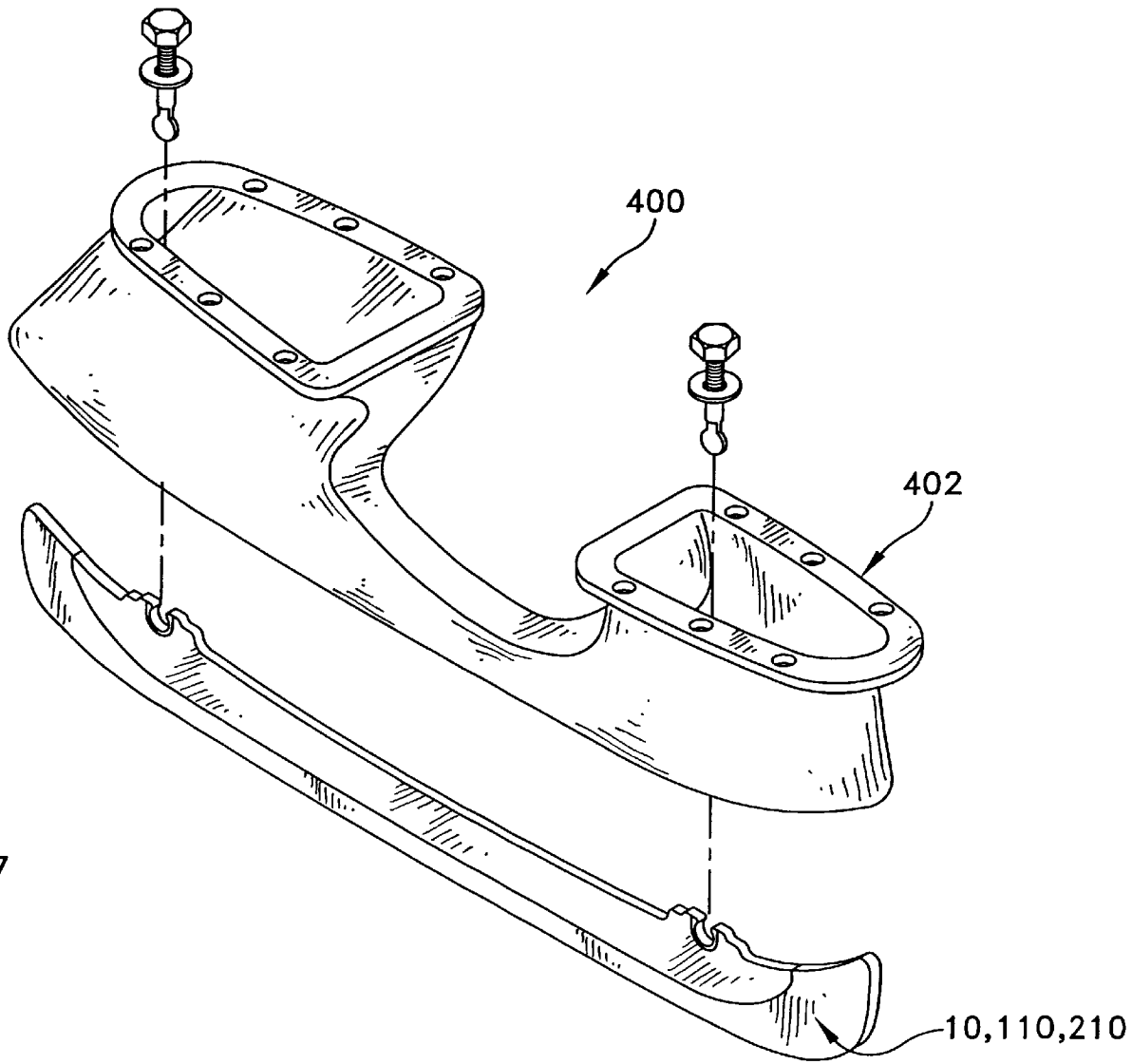
FIG. 17 is a perspective view showing the attachment of the runner and bridge shown FIG. 15.

FIGS. 14 and 15 illustrate two different skate blades 300, 400 in which any of the foregoing runners 10, 110, and 210 may be attached, as is well-known in the art. FIGS. 16 and 17 illustrate the method of attachment of the foregoing runners to the foregoing plastic bridges.

Figure 18:
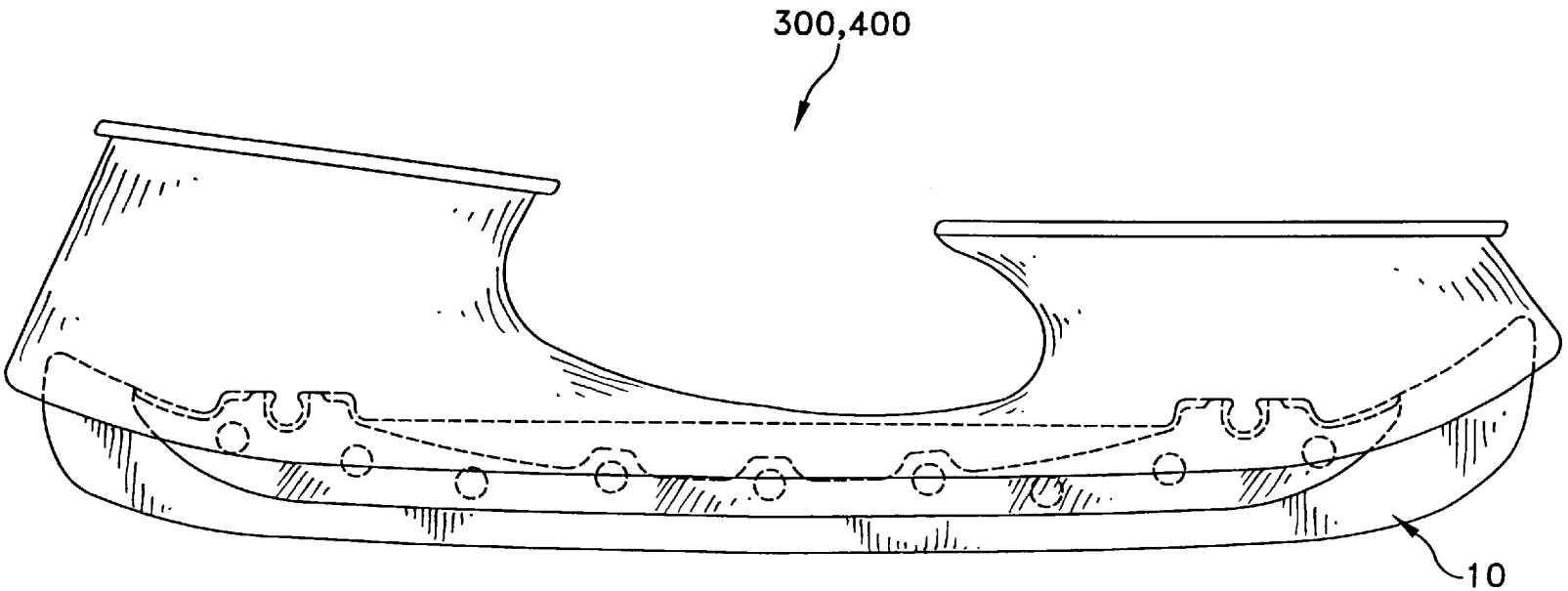
FIG. 18 is a side view of the assembly shown in FIG. 15, showing the runner in outline.

FIG. 18 is a side view of the foregoing plastic bridges showing a phantom outline of runner 10 when inserted into the bridge. As shown, the upper portion of runner 10 extends into the base of the bridge where it may be attached and secured by conventional means. Stabilizing tab 26 of runner 10 also fits into the base to provide additional stabilization at roughly the midpoint of the runner.

Figure 19:
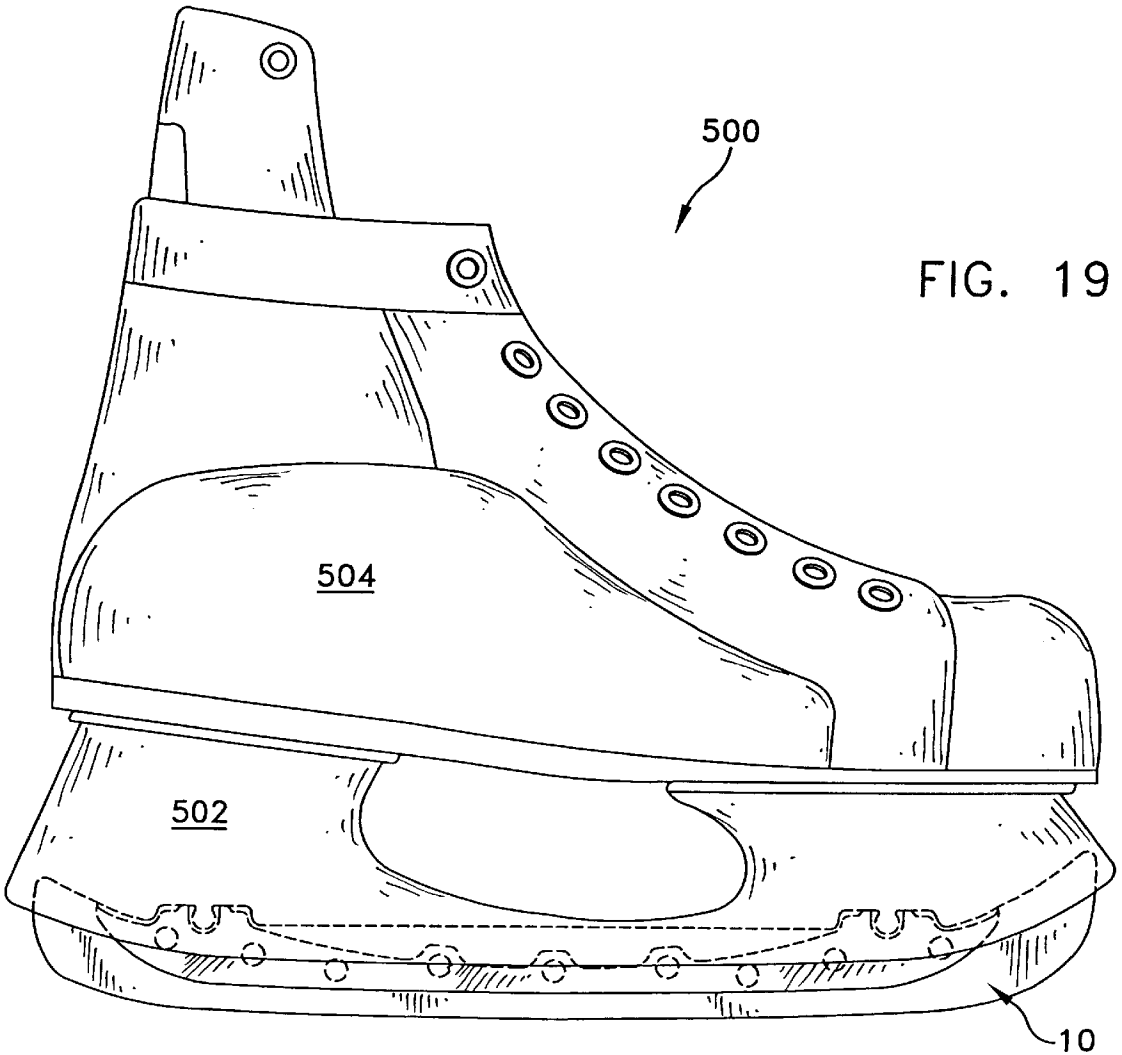
FIG. 19 is a side view of an ice skate according to the present disclosure, showing the runner in outline.

FIG. 19 shows a side view of an ice skate 500 that includes a plastic bridge 502 to which runner 10 is attached in a conventional manner. As shown, ice skate 500 includes an upper 504, which is supported on the plastic bridge 502. As previously indicated, any of the foregoing runners may be used in such an arrangement.

Figure 20:
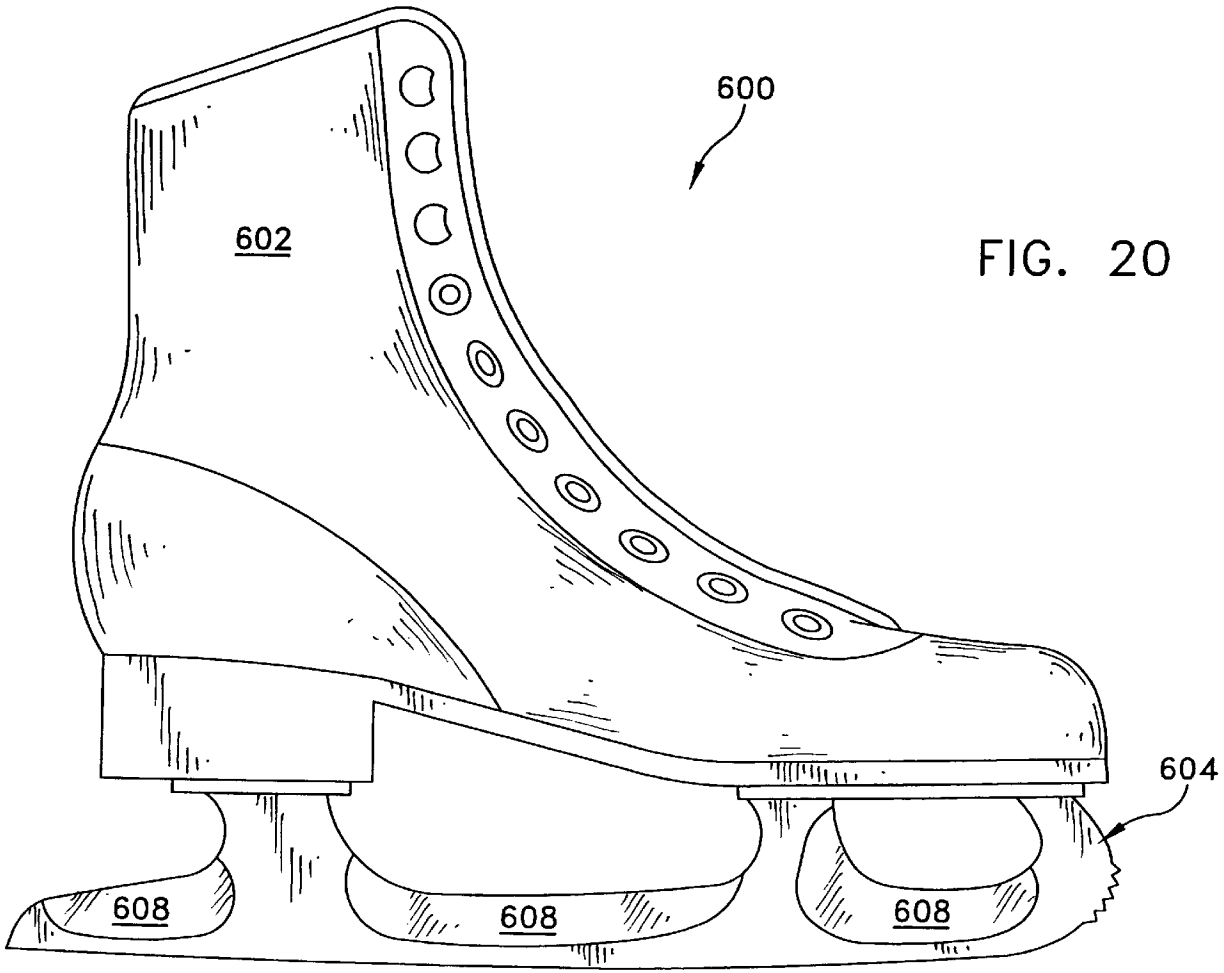
FIG. 20 is a perspective view of a figure skate according to the present disclosure.
Figure 21:
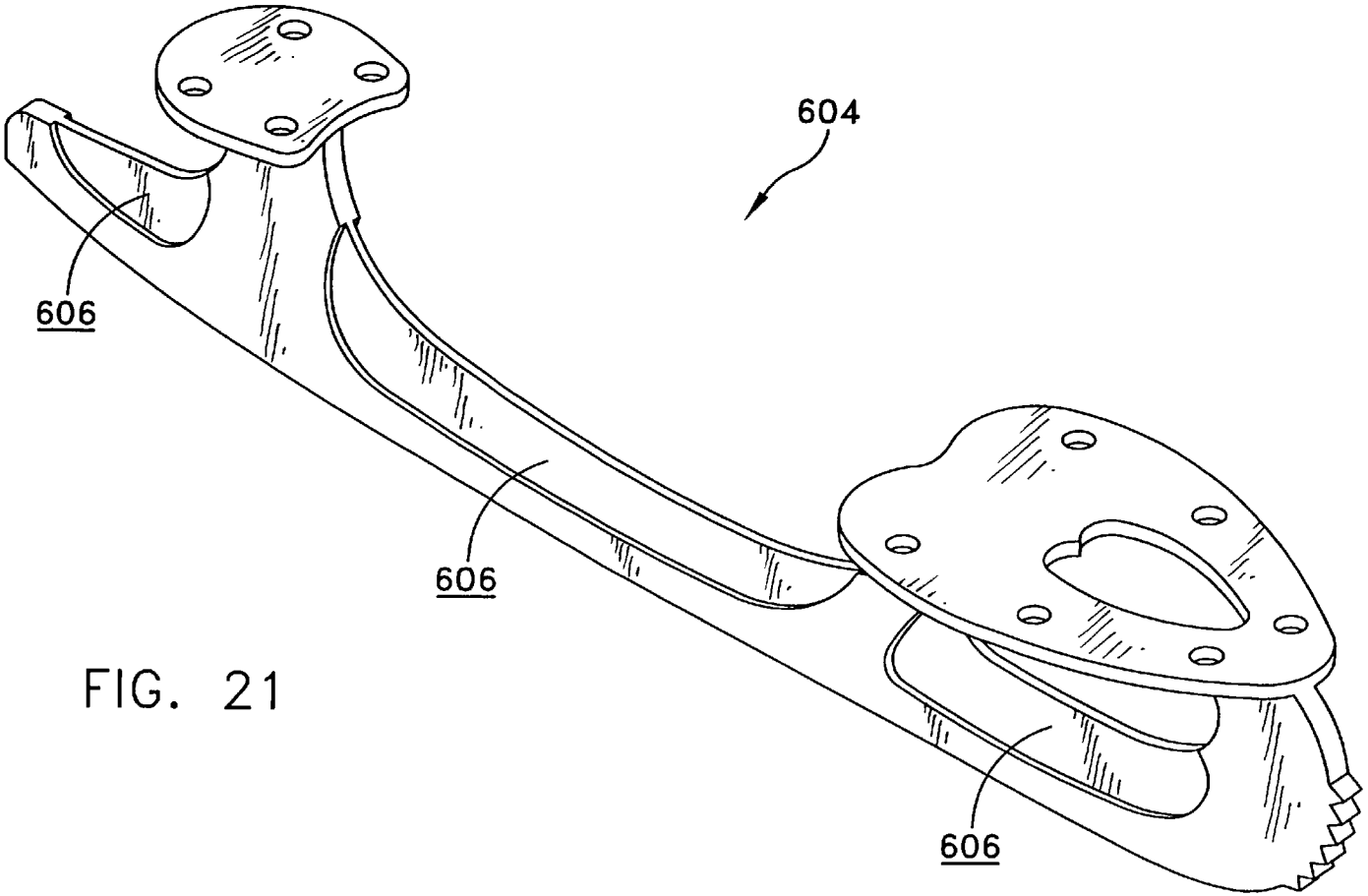
FIG. 21 is a perspective view of the insert blade used to make the skate blade of the figure skate shown in FIG. 20.

FIGS. 20 and 21, when taken together, illustrate a figure skate 600 that includes an upper 602 supported on a skate blade 604. Skate blade 604 includes recessed areas 606 into which plastic may be insert injection molded, in a manner similar to that described previously, to form polymeric portion 608. In this manner, the weight of the figure skate may be reduced in a similar manner to that described with respect to the ice hockey skates. The foregoing applies to speed skate blades and figure skate blades as well.

The weight of commercially available figure skating and speed skating bridges formed solely from steel is much higher than that of a typical commercially available ice hockey runner or ice hockey skate blade, and may range up to about 400 grams for the larger sizes. Again, for practical purposes, the lower limit of the weight of the figure skate blades and speed skate blades according to the present disclosure is limited by the amount of steel required to form the insert blade which may vary depending on the size, shape, and area of the recessed region. Figure and speed skate blades according to the present disclosure may weigh from about 2 percent up to about 90 percent less, by weight, than conventional steel skate blades having the same size and shape, again depending on the type of skate blade, the size, shape, area of the recessed region, and the amount of plastic used to form the skate blade.

WORKING EXAMPLES

Ice hockey runners according to the present disclosure and compatible with a commercially available bridge (Crow) were formed and compared to a conventional stainless steel runner compatible with the same bridge. All weights recorded in the examples below are approximate, measured in grams, and all percentages are percentages by weight based on the total weight of the runners.

Example 1

Two stainless steel 280 mm ice hockey runner blanks were selected. The weight of each of the blanks before machining were both measured and recorded.

One blank was machined in accordance with conventional practice to it final form. The weight of the conventional runners after machining was measured and recorded.

The remaining blank was CNC machined to form the recessed regions, transverse bores, and fastening apertures to obtain an insert blade according to the present disclosure. The weight of the insert blade was measured and recorded. The insert blade was then insert injection molded using the foregoing Nylon 6613GF. The weight of the runner was measured and recorded.

The results of the foregoing are shown below in Table 1.

TABLE 1

| 280 mm size ice hockey runner | Present Runner | Conventional Runner |
|---|---|---|
| Weight of Blank | 162 | 162 |
| Weight of conventional Blade after machining | — | 145 |
| Weight of Insert Blade after CNC machining | 82 | — |
| Weight Present Runner after insert injection molding | 92 | — |
| Final Weight | 92 | 145 |
| Weight % insert blade | 89.1% | — |
| Weight % polymeric portion | 10.9% | — |
| Reduction in Weight as percentage of total weight of conventional runner | 37% | — |

Thus, it can be seen that including about 11 percent by weight of polymeric material in a 280 mm ice hockey runner provides a 37% reduction in weight in comparison to a conventional stainless steel 280 mm ice hockey runner having substantially the same shape, size, and thickness.

Example 2

Two stainless steel 296 mm ice hockey runner blanks were selected and processed as in Example 1. The results of the foregoing are shown below in the Table 2.

TABLE 2

| 296 mm size ice hockey runner | Present Runner | Conventional Runner |
|---|---|---|
| Weight of Blank | 170 | 170 |
| Weight of conventional Blade after machining | — | 158 |
| Weight of Insert Blade after CNC machining | 89 | — |
| Weight Present Runner after insert injection molding | 101 | — |
| Final Weight | 101 | 158 |
| Weight % insert blade | 88.1% | — |
| Weight % polymeric portion | 11.9% | — |
| Reduction in Weight as percentage of total weight of conventional runner | 36% | — |

Thus, it can be seen that including about 12 percent by weight of polymeric material in a 296 mm ice hockey runner provides about a 36% reduction in weight in comparison to a conventional stainless steel 296 mm ice hockey runner having substantially the same shape, size, and thickness.

Although particular embodiments of the disclosure have been described in detail for purposes of illustration, various changes and modifications may be made without departing from the scope and spirit of the disclosure. All combinations and permutations of the structures and methods are available for practice in various applications as the need arises. Accordingly, the disclosure is not to be limited except as by the appended claims. For example, the apparatus and method of the disclosure may be applied to processes that are presently not practically feasible. Accordingly, the disclosure is not to be limited except as by the appended claims.

What is claimed is:

1. A runner, comprising:

an insert blade having an upper edge extending between a toe end and a heel end, a lower skating edge, and opposed side surfaces;

each opposed side surface including a recessed region having a recessed surface, each recessed region being spaced apart from the lower, skating edge and extending between the toe end and the heel end for a preselected distance; and a polymeric material covering at least a portion of each recessed region.

2. The runner of claim 1, wherein a lower edge of each recessed region is defined by a lip.

3. The runner of claim 2, wherein the distance from the lip of each recessed region to the lower, skating edge of the insert blade is at least about ⅛ inch.

4. The runner of claim 2, wherein the distance from the lip of each recessed region to the lower, skating edge of the insert blade is at least about ¼ inch.

5. The runner of claim 2, wherein the distance from the lip of each recessed region to the lower, skating edge of the insert blade is at least about ⅜ inch.

6. The runner of claim 1, wherein the polymeric material covering at least a portion of each recessed region is contiguous with the recessed surface of each recessed region.

7. The runner of claim 1, further comprising at least one bore disposed transversely to a longitudinal axis of the runner and extending through the recessed regions of the insert blade.

8. The runner of claim 1, further comprising at least two apertures constructed and arranged to receive a fastener.

9. The runner of claim 1, further comprising means for fastening the runner to a bridge.

10. The runner of claim 1, wherein the opposing sides surfaces are substantially parallel.

11. The runner of claim 1, wherein the insert blade comprises less than about 98 percent by weight of the runner and the polymeric portion comprises at least about 2 percent by weight of the runner, based on the total weight of the runner.

12. The runner of claim 1, wherein the insert blade comprises less than about 95 percent by weight of the runner and the polymeric portion comprises at least about 5 percent by weight of the runner, based on the total weight of the runner.

13. The runner of claim 1, wherein the insert blade comprises less than about 90 percent by weight of the runner and the polymeric portion comprises at least about 10 percent by weight of the runner, based on the total weight of the runner.

14. The runner of claim 1, wherein the runner is a figure skating runner.

15. The runner of claim 1, wherein the runner is a speed skating runner.

16. The runner of claim 1, wherein the runner is an ice hockey runner.

17. The runner of claim 16, wherein the runner has a total weight of less than about 125 grams.

18. The runner of claim 16, wherein the runner has a total weight of less than about 100 grams.

19. The runner of claim 16, wherein the runner has a total weight of less than about 75 grams.

20. A runner, comprising:

a first surface and a second surface substantially parallel to the first surface, each surface including an insert blade portion having an exterior surface and a polymeric portion having an exterior surface, the exterior surface of the insert blade portion and the exterior surface of the polymeric portion being substantially coplanar;

wherein the runner is capable of being sharpened and contoured.

21. The runner of claim 20, wherein the insert blade portion includes a recessed region contiguous with the polymeric portion.

22. The runner of claim 21, further comprising at least one bore extending transversely through the recessed region.

23. The runner of claim 22, wherein the polymeric portion extends through the at least one bore.

24. The runner of claim 20, further comprising a fastening aperture disposed on an upper edge of the runner.

25. The runner of claim 20, further comprising means for fastening the runner to a bridge.

26. The runner of claim 20, wherein the runner is an ice hockey runner.

27. The runner of claim 20, wherein the runner is a figure skating runner.

28. The runner of claim 20, wherein the runner is a speed skating runner.

29. A runner, comprising:

an insert blade having substantially parallel opposed side surfaces;

a polymeric portion having substantially parallel opposed side surfaces, at least a portion of the polymeric portion in direct contact with the insert blade;

wherein the opposed side surfaces of the insert blade are substantially flush with the opposed side surfaces of the polymeric portion.

30. The runner of claim 29, wherein each side surface of the insert blade includes a recessed region having a surface.

31. The runner of claim 30, wherein the polymeric portion is contiguous with the surface of the recessed region.

32. In combination, a bridge and a runner having substantially parallel opposed side surfaces, the runner including an insert blade at least partially encased in a polymeric material, the polymeric material having an exterior surface that is co-planar with an exterior surface of the insert blade, wherein the runner is removably attached to the bridge.

33. A skate blade, comprising:

a bridge; and a runner having substantially parallel opposed surfaces, each surface including a steel portion having an exterior surface and a polymeric portion having an exterior surface, the exterior surface of the steel portion being substantially co-planar with the exterior surface of the polymeric portion;

wherein at least about ¼ inch of steel extends from a lower edge of the polymeric material to a skating edge of the runner.

34. The runner of claim 33, wherein the runner is an ice hockey runner.

35. The runner of claim 33, wherein the runner is a figure skating runner.

36. The runner of claim 33, wherein the runner is a speed skating runner.

* * * * *